US011270677B2

(12) United States Patent
Park et al.

(10) Patent No.: US 11,270,677 B2
(45) Date of Patent: Mar. 8, 2022

(54) HARMONY SYMBOL INPUT DEVICE AND METHOD USING DEDICATED CHORD INPUT UNIT

(71) Applicant: Juice Co., Ltd., Seoul (KR)

(72) Inventors: Jong Won Park, Gyeonggi-do (KR); Jun Ho Kim, Seoul (KR); Dong Sam Kim, Seoul (KR); Chang Ho Yun, Seoul (KR)

(73) Assignee: Juice Co., Ltd., Seoul (KR)

( * ) Notice: Subject to any disclaimer, the term of this patent is extended or adjusted under 35 U.S.C. 154(b) by 0 days.

(21) Appl. No.: 17/210,551

(22) Filed: Mar. 24, 2021

(65) Prior Publication Data

US 2021/0407472 A1 Dec. 30, 2021

(30) Foreign Application Priority Data

Jun. 29, 2020 (KR) ..... 10-2020-0079008
Jul. 8, 2020 (KR) ..... 10-2020-0084155

(51) Int. Cl.
*G10G 3/04* (2006.01)
*G10G 1/04* (2006.01)
*G10G 1/02* (2006.01)

(52) U.S. Cl.
CPC ..... *G10G 3/04* (2013.01); *G10G 1/02* (2013.01); *G10G 1/04* (2013.01)

(58) Field of Classification Search
CPC ..... G10G 3/04; G10G 1/02; G10G 1/04
See application file for complete search history.

(56) References Cited

U.S. PATENT DOCUMENTS 788,063 A * 4/1905 Quinn ..... G09B 15/08 84/482
1,431,972 A * 10/1922 Mears ..... G10G 1/04 84/474
3,256,765 A * 6/1966 Siegel ..... G10G 1/02 84/478
3,884,112 A * 5/1975 Leonard ..... G10G 1/02 84/471 R
3,884,113 A * 5/1975 Leonard ..... G10G 1/02 84/471 R
3,937,118 A * 2/1976 Leonard ..... G10G 1/02 84/471 SR
3,977,293 A * 8/1976 Leonard ..... G10G 1/02 84/474
4,037,518 A * 7/1977 Garcia Lorenzen . G09B 15/007 84/474
4,064,782 A * 12/1977 Laflamme ..... G10G 1/02 84/477 R (Continued)

*Primary Examiner* — Robert W Horn

(57) ABSTRACT

Disclosed are a harmony symbol input device and method using a dedicated chord input unit. The harmony symbol input device includes: a musical notation provider configured to visualize and provide a musical notation; a chord input unit provider configured to provide a dedicated chord input unit for inputting a harmony symbol in each harmony section of the musical notation; and a harmony symbol display part configured to repeat an operation that provides highlighting for a specific harmony section in a progression order of the musical notation and displays the harmony symbol received from the dedicated chord input unit in relation to the highlighting.

15 Claims, 11 Drawing Sheets

(56) References Cited

U.S. PATENT DOCUMENTS

| | | | | |
|---|---|---|---|---|
| 4,257,306 | A * | 3/1981 | Laflamme | G09B 15/003 341/22 |
| 5,736,666 | A * | 4/1998 | Goodman | G10H 1/38 84/669 |
| 7,435,886 | B2 * | 10/2008 | Shifrin | G09B 15/004 84/313 |
| 8,492,637 | B2 * | 7/2013 | Miyajima | G10H 1/42 84/613 |
| 9,224,373 | B2 * | 12/2015 | Vandendool | G10G 1/02 |
| 9,378,654 | B2 * | 6/2016 | Batiste | G09B 15/023 |
| 10,810,978 | B2 * | 10/2020 | Kubita | G10G 1/02 |
| 2002/0134218 | A1 * | 9/2002 | VanDruff | G10H 1/34 84/609 |
| 2020/0365124 | A1 * | 11/2020 | Pace | G10H 1/34 |

* cited by examiner

FIG. 10

| NO. | VERTICAL HARMONY RULES |
|---|---|
| 1 | Use a diatonic |
| 2 | Observe a range of each vocal part |
| 3 | Prohibit voice overlapping |
| 4 | Prohibit voice crossing |
| 5 | Prohibit an interval between two adjacent vocal parts among three upper vocal parts from exceeding an octave |
| 6 | Make it possible to omit a fifth note of V7 or I in an authentic cadence alone |
| 7 | For inversion<br>-Do not use second inversion for a while<br>-In the case of vii0, double a third note and use only first inversion<br>-Do not use first inversion of iii and vi for a while because iii and vi are used in relation to specific usage |
| 8 | Do not omit any note of a chord<br>-Suggest all of a root note, a third note, and a fifth note ("sufficient" use of a triad)<br>-In the case of v, do not double a third note (which is a leading tone) |

FIG. 11

| NO. | VOCAL PART PROGRESSION RULES |
|---|---|
| 1 | Prohibit two consecutive notes in the same vocal part from exceeding an octave |
| 2 | Prohibited melody progression<br>1) Prohibited melody progression between two intervals<br>-Augmented interval<br>-Leap more than a seventh note or an octave<br>-Four note consecutive leaps in the same direction<br>-No resolution of a leading tone (in the case where a leading tone does not proceed to a tonic)<br>2) Prohibited melody progression between three intervals<br>-Octave leap between three intervals<br>3) Prohibited melody progression between two vocal parts<br>-Parallel 1/5/8 notes<br>-Hidden 5/8 notes |
| 3 | Avoid connection of the same harmony between bars |
| 4 | Resolution of conjunct downward progression of a seventh note of a V7 chord |
| 5 | Resolution of notes<br>1) Resolution of a leading tone<br>-Soprano: The leading tone is always resolved by a tonic<br>-Bass: The leading tone proceeds to one of do, la, and sol<br>2) Resolution of a diminished fifth chord interval<br>-All of the vocal parts are always resolved by conjunct downward/upward progression after diminished fifth chord upward/downward progression |

HARMONY SYMBOL INPUT DEVICE AND METHOD USING DEDICATED CHORD INPUT UNIT

RELATED APPLICATIONS

This application claims the benefit of priority of Korean Patent Application Nos. 10-2020-0079008 filed on Jun. 29, 2020 and 10-2020-0084155 filed on Jul. 8, 2020. The contents of the above applications are all incorporated by reference as if fully set forth herein in their entirety.

FIELD AND BACKGROUND OF THE INVENTION

An embodiment relates to a harmony symbol input technology and, more particularly, to a harmony symbol input device and method using a dedicated chord input unit that is capable of intuitively and effectively inputting various harmony symbols on a musical notation.

A harmony is a temporal flow of a sound generated when a chord is continuous in music, and harmonics handling a method of making a continuous chord is a theory that becomes a basis of musicology along with a counterpoint. That is, the harmonics handles horizontal and vertical structures of the music like tonality, scale, chord, and harmony progressions or cadences, and is a field of study that sums up trends represented in Western classical music.

In internal and external music educations, practice through a musical notation analysis of a four-part chorus type is generally performed to learn harmony. A four-part chorus is a music type composed of four voices of soprano, alto, tenor, and bass (SATB). The four-part chorus is derived from medieval church music, and thus observes very severe rules. The four-part chorus is frequently used in a harmonic education process because concepts of the tonality, scale, chord, and harmony progressions or cadences are well revealed.

In this case, such an evaluation that presents one vocal part and completes the other three vocal parts is mainly performed. For example, a learning degree of the harmonics can be evaluated by presenting the bass vocal part and completing a portion above the bass vocal part.

Meanwhile, in the case where a part of the musical notation is presented as a problem, there is a need to input a harmony symbol into each note on the musical notation in a process of inputting a solution to the problem, but an input device for this is not separately present, and thus there is a problem in that a process of inputting the harmony symbol is inconvenient.

SUMMARY OF THE INVENTION

An embodiment of the present disclosure is directed to providing a harmony symbol input device and method using a dedicated chord input unit capable of intuitively and effectively inputting various harmony symbols on a musical notation.

Further, an embodiment of the present disclosure is directed to providing a harmony symbol input device and method capable of visually displaying a process of scoring a musical notation input by a user to improve an effect of learning.

Further, an embodiment of the present disclosure is directed to providing a harmony symbol input device and method capable of learning harmonics in an interactive way between a user and a system, and visualizing and providing a result of scoring a harmony problem.

In addition, an embodiment of the present disclosure is directed to providing a harmony symbol input device and method capable of providing intuitive feedback to an input of a user who resolves a problem with harmonics to increase efficiency of learning.

According to an embodiment, there is provided a harmony symbol input device using a dedicated chord input unit, which includes a musical notation provider configured to visualize and provide a musical notation, a chord input unit provider configured to provide a dedicated chord input unit for inputting a harmony symbol in each harmony section of the musical notation, and a harmony symbol display part configured to repeat an operation that provides highlighting for a specific harmony section in a progression order of the musical notation and displays the harmony symbol received from the dedicated chord input unit in relation to the highlighting. The dedicated chord input unit is made up of partial key lists that are vertically disposed side by side and are generated on the basis of a set of partial keys.

The disclosed technology may have the following effects. However, this does not mean that a specific embodiment should include all of the following effects or only the following effects, and thus it should not be understood that the scope of the disclosed technology is restricted by the specific embodiment.

A harmony symbol input device and method using a dedicated chord input unit according to an embodiment of the present disclosure can intuitively and effectively input various harmony symbols on a musical notation.

A harmony symbol input device and method using a dedicated chord input unit according to an embodiment of the present disclosure can provide a guide for inputting a harmony symbol and a simple feedback of the input of the harmony symbol to support a composition.

A harmony symbol input device and method using a dedicated chord input unit according to an embodiment of the present disclosure can learn harmonics in an interactive way between a user and a system, and visualize and provide a scoring content relevant to a problem with harmonics.

A harmony symbol input device and method using a dedicated chord input unit according to an embodiment of the present disclosure can provide intuitive feedback with respect to an input of a user who is resolving a problem with harmonics and increase efficiency of learning.

BRIEF DESCRIPTION OF THE SEVERAL VIEWS OF THE DRAWINGS

The above and other objects, features and advantages of the present disclosure will become more apparent to those of ordinary skill in the art by describing exemplary embodiments thereof in detail with reference to the accompanying drawings, in which:

FIG. 10 is a diagram illustrating vertical harmony scoring rules according to the present disclosure;

FIG. 11 is a diagram illustrating horizontal harmony scoring rules according to the present disclosure;

DESCRIPTION OF SPECIFIC EMBODIMENTS OF THE INVENTION

Figure 1:
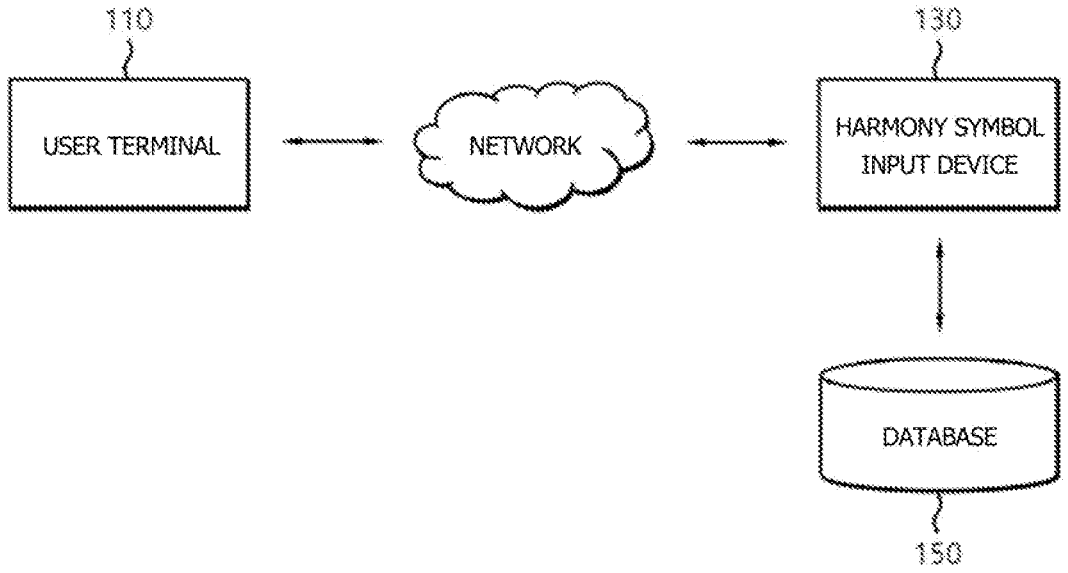
FIG. 1 is a diagram illustrating a harmony symbol input system according to the present disclosure.

FIG. 1 is a diagram illustrating a harmony symbol input system according to the present disclosure.

Referring to FIG. 1, a harmony symbol input system 100 may include a user terminal 110, a harmony symbol input device 130, and a database 150.

The user terminal 110 may be equivalent to a computing device that can display a musical notation, receive a musical notation input by a user, and perform learning or evaluation of harmonics, may be implemented by a smartphone, a laptop computer, or a computer, and without being necessarily limited thereto, may be implemented by various devices such as a tablet personal computer (PC). The user terminal 110 may be connected with the harmony symbol input device 130 through a network, and a plurality of user terminals 110 may be simultaneously connected with the harmony symbol input device 130.

Further, the user terminal 110 may provide an interface that can input harmony symbols into notes on a musical notation input by a user in a process of evaluating harmonics. To this end, a dedicated program or application that provides a dedicated chord input unit for inputting harmony symbols may be installed and executed. As another example, the user terminal 110 may reproduce a musical notation input by a user in a process of evaluating harmonics, and a dedicated program or application for the reproduction may be installed and executed.

The harmony symbol input device 130 may be implemented by a server equivalent to a computer or a program that provides a dedicated chord input unit to the user terminal 110, and generates and displays harmony symbols on the basis of key signals received through the dedicated chord input unit. The harmony symbol input device 130 may be connected with the user terminal 110 through a network and may transmit and receive information. Further, the harmony symbol input device 130 may provide UI/UX that is variously implemented to provide user convenience in a process of providing a musical notation and a dedicated chord input unit and receiving a harmony symbol.

In an embodiment, the harmony symbol input device 130 may be interlocked with the database 150 and store various pieces of data required to input harmony symbols. Further, the harmony symbol input device 130 may be implemented by including a processor, a memory, a user input/output part, and a network input/output part. These parts will be described in more detail with reference to FIG. 2.

The database 150 may be equivalent to a storage device that stores various pieces of information required in an operation process of the harmony symbol input device 130. The database 150 may store information about a musical notation, a dedicated chord input unit, and a chord symbol and store a harmonic musical notation for harmonics learning or evaluation, a scoring model, a scoring result, and an analyzing result according to each user. Here, the harmonic musical notation may include a testing musical notation provided from the harmony symbol input system 100 and a scoring musical notation received from the user terminal 110 and, without being necessarily limited thereto, may include various existing musical notations such as a classic, a pop song, a popular song, new age music, jazz, a hymn, and so on.

Further, the database 150 may store data and programs required to operate the harmony symbol input system 100. The database 150 may store various graphic user interfaces (GUIs) for visualizing the harmonic musical notation, the dedicated chord input unit, the scoring model, the scoring result, and the analyzing result and, without being necessarily limited thereto, may store pieces of information that are collected or processed in various forms in a process in which the harmony symbol input device 130 provides a musical notation and receives a harmony symbol.

Figure 2:
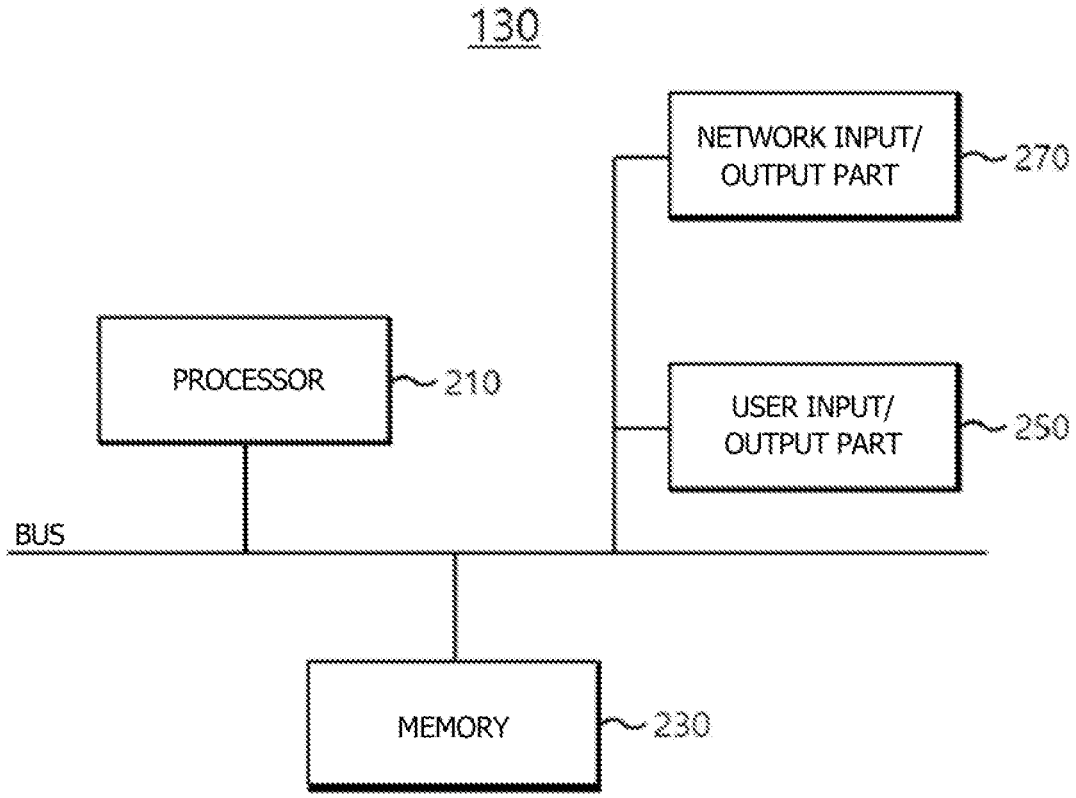
FIG. 2 is a diagram illustrating a systemic configuration of a harmony symbol input device of FIG. 1.

FIG. 2 is a diagram illustrating a systemic configuration of the harmony symbol input device of FIG. 1.

Referring to FIG. 2, the harmony symbol input device 130 may be implemented by including a processor 210, a memory 230, a user input/output part 250, and a network input/output part 270.

The processor 210 may execute a procedure that processes each step in a process in which the harmony symbol input device 130 is operated, manage the memory 230 that is read or written in the whole process, and schedule a synchronization time between volatile and nonvolatile memories that are present in the memory 230. The processor 210 may control the whole operation of the harmony symbol input device 130, may be electrically connected with the memory 230, the user input/output part 250, and the network input/output part 270, and may control a data flow between these parts. The processor 210 may be implemented by a central processing unit (CPU) of the harmony symbol input device 130.

The memory 230 may include an auxiliary memory that is implemented by a nonvolatile memory such as a solid-state drive (SSD) or a hard disk drive (HDD) and is used to store all of the data required for the harmony symbol input device 130, and include a main memory that is implemented by a volatile memory such as a random-access memory (RAM).

The user input/output part 250 may include an environment for receiving a user input and an environment for outputting specific information to a user. For example, the user input/output part 250 may include an input device that includes an adaptor such as a touch pad, a touch screen, an on-screen keyboard, or a pointing device, and an output device that includes an adaptor such as a monitor or a touch screen. In an embodiment, the user input/output part 250 may be equivalent to a computing device that is accessed through remote access. In this case, the harmony symbol input device 130 may serve as a server.

The network input/output part 270 includes an environment for connection with an external device or system through a network, and may include adaptors for communication, for example, such as a local area network (LAN), a metropolitan area network (MAN), a wide area network (WAN), and a value-added network (VAN).

Figure 3:
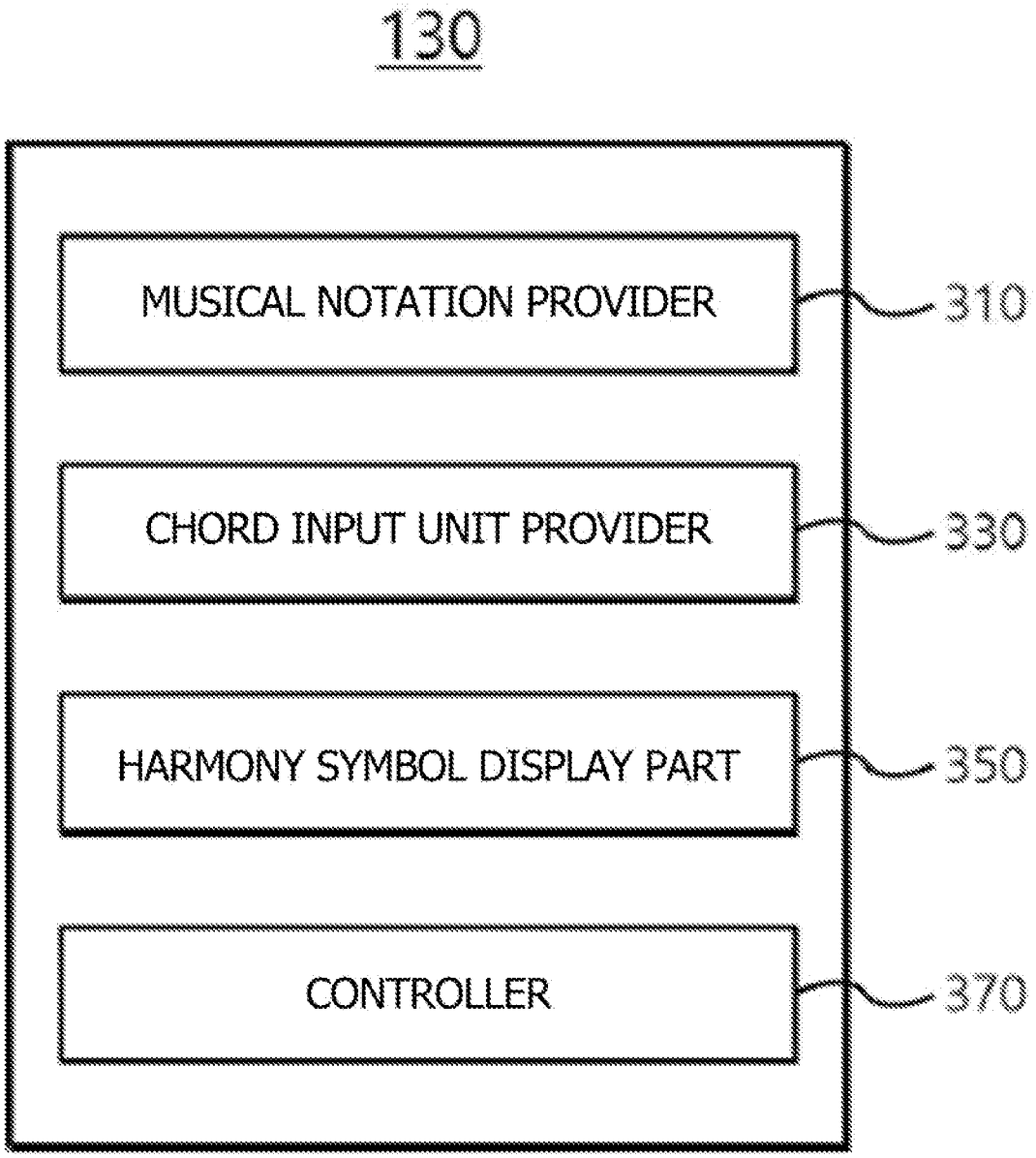
FIG. 3 is a diagram illustrating a functional configuration of the harmony symbol input device of FIG. 1.

FIG. 3 is a diagram illustrating a functional configuration of the harmony symbol input device of FIG. 1.

Referring to FIG. 3, the harmony symbol input device 130 may include a musical notation provider 310, a testing musical notation provider 320, a chord input unit provider 330, a scoring musical notation input part 340, a harmony symbol display part 350, a harmony scoring element overlay part 360, and a controller 370.

The musical notation provider 310 may visualize and provide a musical notation. The musical notation provider 310 may basically perform a visualizing operation on the basis of a musical notation stored in the database 150 but, without being necessarily limited thereto, may receive a musical notation from an external system through a network and then perform a visualizing operation on the basis of the received musical notation. The musical notation provider 310 may provide a visualized musical notation to the user terminal 110, and the user terminal 110 may receive the visualized musical notation and output the musical notation through a display screen.

Meanwhile, the musical notation provider 310 may perform a transforming operation of applying transformation rules to musical notation data stored in the database 150 and causing the musical notation data to be visually expressed on a screen. That is, the harmony symbol input device 130 may, in advance, establish and utilize the transformation rules for transforming the musical notation graphically visualized on the screen into data in a form that the musical notation can be stored in the database 150. The musical notation provider 310 may inversely apply the transformation rules and thereby can graphically visualize the musical notation data stored in the database 150 on the screen.

In an embodiment, the musical notation provider 310 may include a testing musical notation providing module that provides a testing musical notation, a scoring musical notation providing module that provides a scoring musical notation generated depending on a selection input of a user on the basis of the testing musical notation, and a musical notation visualizing module that visually distinguishes and displays the testing musical notation and the scoring musical notation.

More specifically, the testing musical notation providing module may directly output the testing musical notation through an internal display screen connected on its own or may indirectly output the testing musical notation through an external display screen connected by a network such as the user terminal 110. Here, the testing musical notation may be equivalent to a musical notation that includes tonality, scale, chord, and harmony progression information about a specific vocal part as a problem for a harmonic test. Here, the vocal part may include soprano, alto, tenor, bass, and so on.

That is, the testing musical notation providing module may provide a musical notation relevant to at least one of the four vocal parts as a testing musical notation, and a user may complete a musical notation for the remaining vocal parts to be input as a solution to the testing musical notation, namely a scoring musical notation. Further, the testing musical notation providing module may utilize various musical notations stored in the database 150 to generate the testing musical notation, and utilize various interfaces for outputting the testing musical notation.

Further, the scoring musical notation providing module may receive a scoring musical notation based on a musical instrument playing input or a harmony input depending on an input selection of a user. That is, the scoring musical notation providing module may directly receive the scoring musical notation, as a solution to the testing musical notation, from the user terminal 110. To this end, the scoring musical notation providing module may provide an interface for inputting a musical notation and, especially, provide the interface in a way that is integrated with an interface for providing the testing musical notation. The scoring musical notation may include tonality, scale, chord, and harmony progression information about a vocal part other than a vocal part provided from the testing musical notation as a musical notation input by a user.

Further, the musical notation visualizing module may visually distinguish the testing musical notation and the scoring musical notation and output these musical notations on a screen. When a user inputs a harmony symbol while performing harmonic evaluation, the user should be able to simultaneously check the testing musical notation and the scoring musical notation input by the user has input through a screen. The musical notation visualizing module visually distinguishes and displays the testing musical notation and the scoring musical notation that are output on the screen, and thereby can support these musical notations such that a user can easily distinguish these musical notations.

Meanwhile, a visualizing method used in this case may include a method of basically applying at least one of a color, a shape, and a form in a different way. However, without necessarily being limited thereto, the visualizing method may include methods implemented in various ways such as a method of causing only a specific musical notation to flicker, a method of differently applying transparency of a specific musical notation, or a method of displaying a musical notation using a separate identifier.

The chord input unit provider 330 may provide a dedicated chord input unit for inputting a harmony symbol in each harmony section of a musical notation. Here, the dedicated chord input unit may be generated on the basis of at least two partial key lists which are vertically disposed side by side and each of which is a set of partial keys. The dedicated chord input unit may correspond to an interface that is newly devised to input a harmony symbol. The partial key list may be equivalent to a set of commands capable of independently inputting a partial key required to input a harmony symbol and may be implemented by including an interface capable of executing each command.

For example, the partial key list may include an interface in which button commands corresponding to the partial keys are each disposed horizontally. In this case, the dedicated chord input unit may be implemented similarly to a keyboard layout of a character input unit, and a user may determine a harmony symbol to be input by selecting partial keys in order.

In an embodiment, each partial key list may be generated on the basis of a set including {'I', 'V', 'i', 'v', '+', 'o', 'ø', '6', '$_4^6$', '7'} or {'b', '#', 'N', 'Ger', 'It', 'Fr', '$_5^6$', '$_3^4$', '$_2^4$', '/' } and may be implemented by an interface that can independently select each partial key. Elements of the set {'I', 'V', 'i', 'v', '+', 'o', 'ø', '6', '$_4^6$', '7' } and the set {'b', '#', 'N', 'Ger', 'It', 'Fr', '$_5^6$', '$_3^4$', '$_2^4$', '/' } may be made up of symbols essential to form a harmony symbol, and the partial key may be defined in correspondence to each of the elements.

That is, the partial keys may be structured and defined to be able to determine a specific harmony symbol only by minimal selection while expressing all the harmony symbols. A user can successively select partial keys through the dedicated chord input unit and input proper harmony symbols for notes included in a musical notation. Further, each partial key list may be generated in such a way that partial keys are placed in the order of frequency of use.

In an embodiment, the chord input unit provider 330 may be operated through a step of detecting a change in bar in the progression of a musical notation, a step of, in the case where the change is detected, extracting at least one note included in the changed bar from the musical notation, a step of generating a set of harmony symbols generated by combination of the at least one note, a step of determining essential partial keys required to input the harmony symbol for the changed bar on the basis of the set of harmony symbols, and a step of activating and providing only the essential partial keys on a dedicated chord input unit in the process of inputting the harmony symbol for the changed bar.

More specifically, the chord input unit provider 330 may detect a change in bar in the progression of a musical notation. That is, the chord input unit provider 330 may obtain information about the progression of the musical notation as a harmony symbol is generated by a selection input of a user through a dedicated chord input unit. The chord input unit provider 330 may determine a change in bar on the basis of a length of a note included in a musical notation. For example, in the case where a total length of notes passed in the progression of the musical notation exceeds a length of a preset bar, the chord input unit provider 330 may determine that a change in bar occurs.

Further, in the case where a change in bar is detected, the chord input unit provider 330 may extract at least one note included in the changed bar from the musical notation. That is, the chord input unit provider 330 may extract all notes included in the changed bar, that is, a newly progressing bar, but may extract only one note in the case of overlapped notes.

Further, the chord input unit provider 330 may generate a set of harmony symbols generated by a combination of at least one note. That is, the chord input unit provider 330 may obtain information about harmony symbols that can be expressed by a combination of notes included in one bar after extracting notes in units of bar.

Further, the chord input unit provider 330 may determine essential partial keys required to input the harmony symbol for the changed bar on the basis of the set of harmony symbols. In the case where a partial key that is not at all used in the process of inputting the harmony symbol included in the set of harmony symbols is present, the chord input unit provider 330 may exclude the partial key from the essential partial keys.

Further, the chord input unit provider 330 may activate and provide only the essential partial keys on a dedicated chord input unit in the process of inputting the harmony symbol for the changed bar. In the case where the partial keys are not the essential partial keys, there is no possibility of the partial keys being used when the harmony symbol is input for the changed bar. Thus, the chord input unit provider 330 may inactivate all the partial keys to support partial key selection for a harmony symbol input of a user.

In an embodiment, in the case where the continuous input of the harmony symbol is determined by the harmony symbol display part 350, the chord input unit provider 330 may determine the partial keys that can be merged with a first harmony symbol that is previously received and displayed and may visualize and provide the partial keys so as to be distinguished from the other keys on the dedicated chord input unit.

For example, a user may sequentially select and input partial keys in order to input a harmony symbol. In the case where selection of a total of three partial keys is required to input one harmony symbol in this process, the harmony symbol display part 350 may determine a continuous input whenever the user selects each of first and second partial keys. In the case where a user selects a first or second partial key and then selection of a second or third partial key is required, the chord input unit provider 330 may display and provide partial keys that can be merged with the previously selected partial key so as to be distinguished from the other keys on the dedicated chord input unit. A method of distinguishing between the partial keys may include a color changing method or an activation/inactivation switching method.

The harmony symbol display part 350 may repeat an operation that provides highlighting for a specific harmony section in a progression order of a musical notation and displays a harmony symbol received from the dedicated chord input unit in relation to the highlighting. Here, the harmony section may be a set of notes representing the progression of the harmony and may be equivalent to a time frame that forms one harmony. Therefore, the highlighting of the harmony section may be advanced in correspondence to the progression order of a musical notation. In the case where an input of a harmony symbol for one harmony section is completed, the highlighting may move to the next harmony section and may proceed.

For example, the harmony symbol display part 350 may generate a highlighted region of a quadrilateral structure which includes notes of a specific harmony section and display the highlighted region with a color distinguished from the other regions. Further, the harmony symbol display part 350 may display a harmony symbol received from the dedicated chord input unit in the highlighted region or in an external region adjacent to the highlighted region.

In an embodiment, the harmony symbol display part 350 may determine whether to continue inputting a harmony symbol for a specific harmony section while successively receiving a partial key based on selection of a user for the dedicated chord input unit. For example, the harmony symbol display part 350 may add a partial key to a partial key list whenever a selection input of a user is received. Here, the partial key list may be equivalent to a data structure in which partial keys are connected in an input order. The harmony symbol display part 350 may determine whether a conjunct combination of the partial keys included in the partial key list corresponds to a specific harmony symbol and determine whether or not to continue inputting a harmony symbol on the basis of that result.

Meanwhile, the harmony symbol display part 350 may determine a state transition based on a current state at each time of the input of the partial key from the dedicated chord input unit and determine whether or not to continue inputting a harmony symbol on the basis of a transition state. To this end, the harmony symbol display part 350 may define and utilize a state set, an initial state, an end state, a partial key set, and a state transition function. The state set may be equivalent to a set that includes "input continuation" and "input end". The initial state may be equivalent to the "input continuation", and the end state may be equivalent to the "input end". The partial key set may be equivalent to a set of partial keys input through the dedicated chord input unit, and the state transition function may be defined including information about the next state determined depending on a partial key input in each state.

In an embodiment, in the case where the input of a harmony symbol is continued, when a partial key that can be merged with the first harmony symbol that is previously received and displayed is received, the harmony symbol display part 350 may generate a second harmony symbol based on the mergence and display the second harmony symbol in place of the first harmony symbol. However, in the case where the input of a harmony symbol is continued, when a partial key that can be merged with the first harmony symbol is received, the harmony symbol display part 350 may terminate the input of a harmony symbol for a specific harmony section and automatically proceed to a harmony section next to the specific harmony section. Here, the first harmony symbol may be equivalent to a combination result based on the selection of the partial key so far, and the second harmony symbol may be equivalent to a combination result between the first harmony symbol and the partial key based on a selection input of a user at a current point of time.

That is, when a combinable partial key is received, the harmony symbol display part 350 may merge a new partial key into the existing first harmony symbol and generate a second harmony symbol. However, when a non-combinable partial key is received, the harmony symbol display part 350 may determine that an input of the previous harmony symbol is completed and move to the next harmony section. Meanwhile, in the case where the non-combinable partial key is received and the first harmony symbol does not correspond to a preset independent harmony symbol, the harmony symbol display part 350 may provide a message about an input error and then request an input of a partial key again. When a harmony symbol is input in a harmonic evaluation process, the harmony symbol display part 350 may not generate a separate error message even when an abnormal partial key is input and may continuously perform a receiving operation for a selection input of a user.

In an embodiment, the harmony symbol display part 350 may determine a specific harmony section depending on a selection input of a user on a visualized and displayed musical notation and visualize and display a bar included in the specific harmony section so as to be distinguished from the other bars on the musical notation. A user may select a specific note or a specific bar on a musical notation visualized and displayed on a screen, and the harmony symbol display part 350 may provide a display for distinguishing a bar to a start portion of the bar such that the bar associated with the selection is distinguished from the other bars.

Meanwhile, the harmony symbol display part 350 may highlight and display a harmony section in which a specific note is included on the basis of the selection of a user. When the specific bar is selected, the harmony symbol display part 350 may highlight and display a first harmony section of the specific bar. In the case where a harmony section in which a harmony symbol is given to the specific bar in advance is present, the harmony symbol display part 350 may highlight and display a harmony section next to the harmony section.

In an embodiment, the harmony symbol display part 350 may provide a simple feedback for an input harmony symbol while displaying a harmony symbol received from the dedicated chord input unit in relation to highlighting. More specifically, the harmony symbol display part 350 may define a harmony region in consideration of formerly connected harmony sections on the basis of the highlighted harmony section and generate an evaluation of a currently input harmony symbol on the basis of a flow of harmonies in the harmony region. For example, an evaluation that corresponds to any one of good, average, and bad depending on whether the currently input harmony symbol corresponds to a harmony symbol suitable for the flow of harmonies may be determined.

The controller 370 may control a whole operation of the harmony symbol input device 130 and manage a control flow or a data flow among the musical notation provider 310, the chord input unit provider 330, and the harmony symbol display part 350.

Figure 4:
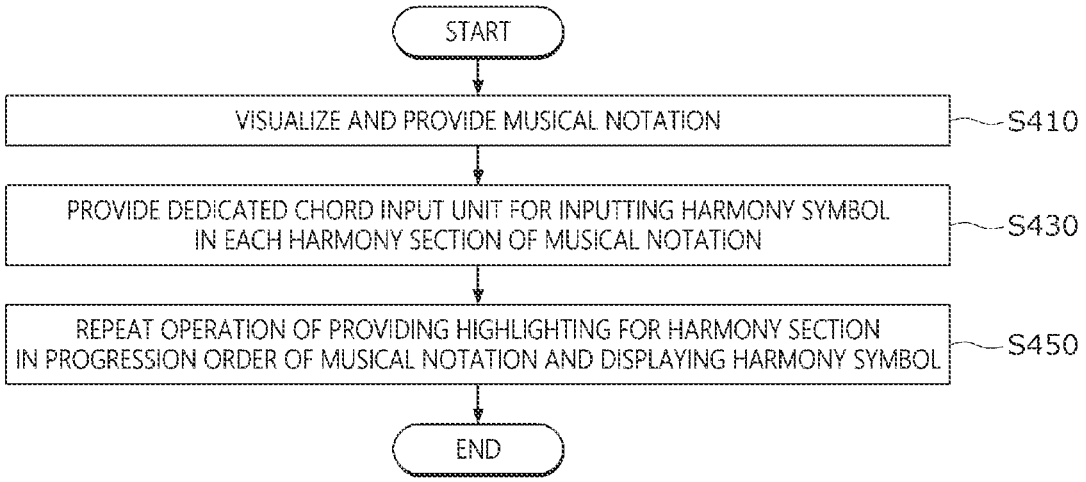
FIG. 4 is a flow chart illustrating a harmony symbol input process using a dedicated chord input unit according to an embodiment of the present disclosure.

FIG. 4 is a flow chart illustrating a harmony symbol input process using a dedicated chord input unit according to an embodiment of the present disclosure.

Referring to FIG. 4, the harmony symbol input device 130 may visualize and provide a musical notation through the musical notation provider 310 (step S410). The user terminal 110 may output the musical notation provided from the harmony symbol input device 130 through a display screen. The harmony symbol input device 130 may provide a dedicated chord input unit for inputting a harmony symbol on the basis of a harmony section of the musical notation through the chord input unit provider 330 (step S430). A user can easily input a harmony symbol corresponding to each harmony displayed on the musical notation through the dedicated chord input unit.

Further, the harmony symbol input device 130 may repeat an operation that provides highlighting for a specific harmony section in a progression order of the musical notation through the harmony symbol display part 350 and displays a harmony symbol received from the dedicated chord input unit in relation to the highlighting (step S450). That is, when an input of the harmony symbol on the basis of the harmony section is completed by an input of a user, the harmony symbol input device 130 may automatically proceed to the next harmony section and highlight notes included in the next harmony section, thereby providing an intuitive understanding of a currently proceeding harmony section to the user.

Figure 5:
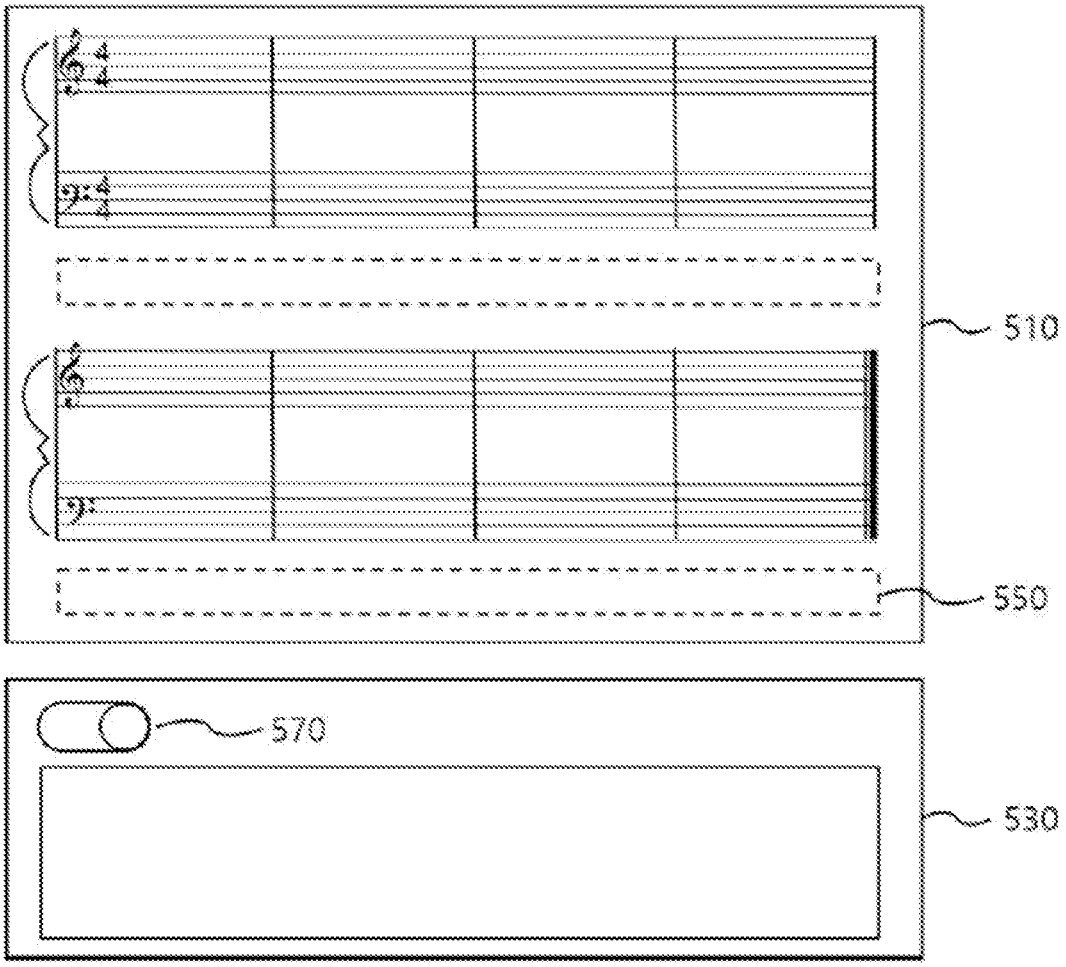
FIG. 5 is a diagram illustrating a harmony symbol input interface according to an embodiment of the present disclosure.

FIG. 5 is a diagram illustrating a harmony symbol input interface according to an embodiment of the present disclosure.

Referring to FIG. 5, the harmony symbol input device 130 may provide an interface for inputting a harmony symbol. The user terminal 110 may output the dedicated chord input unit on a screen along with the musical notation using the interface and install and execute a dedicated program or application therefor.

In FIG. 5, the interface for inputting a harmony symbol may be made up of a musical notation region 510 that displays a musical notation and an input unit region 530 that displays the dedicated chord input unit, and a harmony symbol display region 550 may be located within the musical notation region 510. That is, the harmony symbol display region 550 is disposed at a lower end of the musical notation, and thereby can be naturally connected with notes on the musical notation. The dedicated chord input unit may be displayed on the input unit region 530, and a toggle button 570 may be disposed at an upper end of the dedicated chord input unit and may change the interface for inputting a harmony symbol by a selection of a user.

Figure 6:
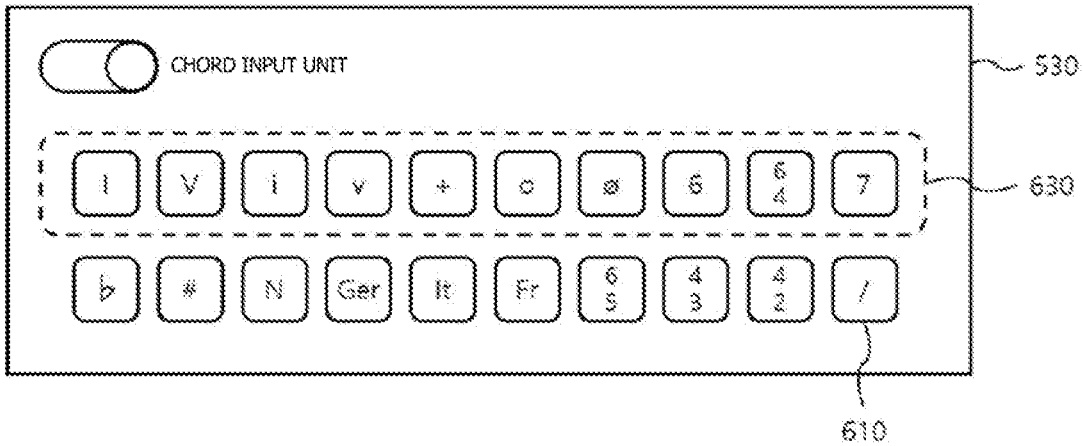
FIG. 6 is a diagram illustrating a dedicated chord input unit according to an embodiment of the present disclosure.

FIG. 6 is a diagram illustrating a dedicated chord input unit according to an embodiment of the present disclosure.

Referring to FIG. 6, the harmony symbol input device 130 may provide a dedicated chord input unit within the input unit region 530. A user may easily input a harmony symbol through the dedicated chord input unit. Meanwhile, in the case where a user of a mobile phone uses a QWERTY keyboard to input a harmony symbol, it is difficult to properly check a musical notation displayed on a screed due to space shortage. In the case where a user uses a filtering mode using a dropdown button, the user may suffer much inconvenience in inputting a harmony symbol in the point that a process of four clicks and selections is required. By providing an interface capable of intuitively inputting a harmony symbol only by selection of a minimum number of buttons required to input a harmony symbol, the harmony symbol input device 130 may eliminate inconvenience of an input process to improve convenience for a user while minimizing a space occupied by the input unit.

Further, in the case of the dedicated chord input unit provided within the input unit region 530 by the harmony symbol input device 130, buttons corresponding to partial keys 610 may be placed in a regular form. Particularly, the dedicated chord input unit may have at least two partial key lists 630 disposed side by side in a vertical direction, and each of the partial key lists 630 may be generated on the basis of a set of the partial keys 610. In FIG. 6, the dedicated chord input unit may be made up of two partial key lists 630. The partial key list 630 disposed at an upper end may be configured to include the partial keys 610 composed of {'I', 'V', 'i', 'v', '+', 'o', 'ø', '6', '$_4^6$', '7' }, and the partial key list 630 disposed at a lower end may be configured to include the partial keys 610 composed of {'b', '#', 'N', 'Ger', 'It', 'Fr', '$_5^6$', '$_3^4$', '$_2^4$', '/'}.

Figure 7:
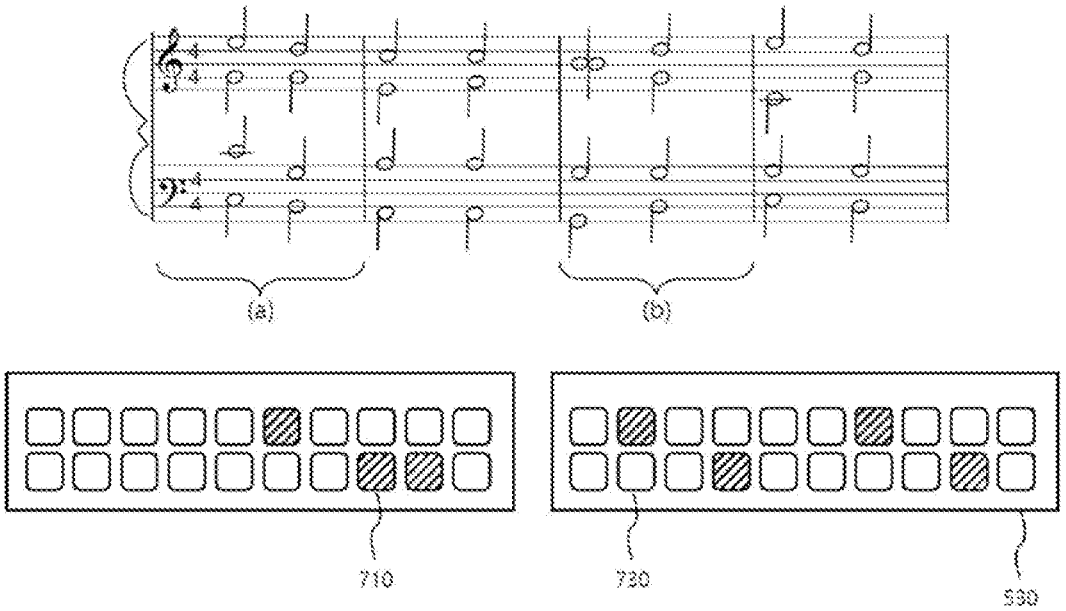
FIG. 7 is a diagram illustrating a process of providing the dedicated chord input unit according to an embodiment of the present disclosure.

FIG. 7 is a diagram illustrating a process of providing a dedicated chord input unit according to an embodiment of the present disclosure.

Referring to FIG. 7, the harmony symbol input device 130 may detect a change in bar based on the progression of a musical notation. In the case where a change in bar is detected, the harmony symbol input device 130 may determine whether or not to activate partial keys on the dedicated chord input unit on the basis of notes of the changed bar. That is, the partial keys that have no possibility to be used in a process of inputting a harmony symbol of the bar are changed to an inactivated state, and thus the harmony symbol input device 130 may support enabling a user to more accurately input the harmony symbol.

Meanwhile, the harmony symbol input device 130 may stop an operation of changing an activated state for the partial keys if necessary. For example, in the case of receiving an input for a harmony symbol in the harmonic evaluation process, an incorrect input should be processed as a normal input, and thus the harmony symbol input device 130 may have control such that an inactivation operation for unnecessary partial keys is not performed.

In FIG. 7, in the case of inputting a harmony symbol for harmony sections of a first bar (a) on a musical notation, the harmony symbol input device 130 may provide a dedicated chord input unit in which a total of three partial keys are changed into an inactivated state. In the case of inputting a harmony symbol for harmony sections of a third bar (b) on a musical notation, the harmony symbol input device 130 may provide a dedicated chord input unit in which a total of four partial keys are changed into an inactivated state. To this end, whenever the bar is changed, the harmony symbol input device 130 may determine whether or not each partial key of the dedicated chord input unit is activated and may provide a dedicated chord input unit made up of inactivated partial keys 710 and activated partial keys 730 by reflecting the result of the determination.

Meanwhile, the harmony symbol input device 130 may detect a change in a bar section including at least one bar and perform an inactivation operation on partial keys that are not available for use.

Figure 8:
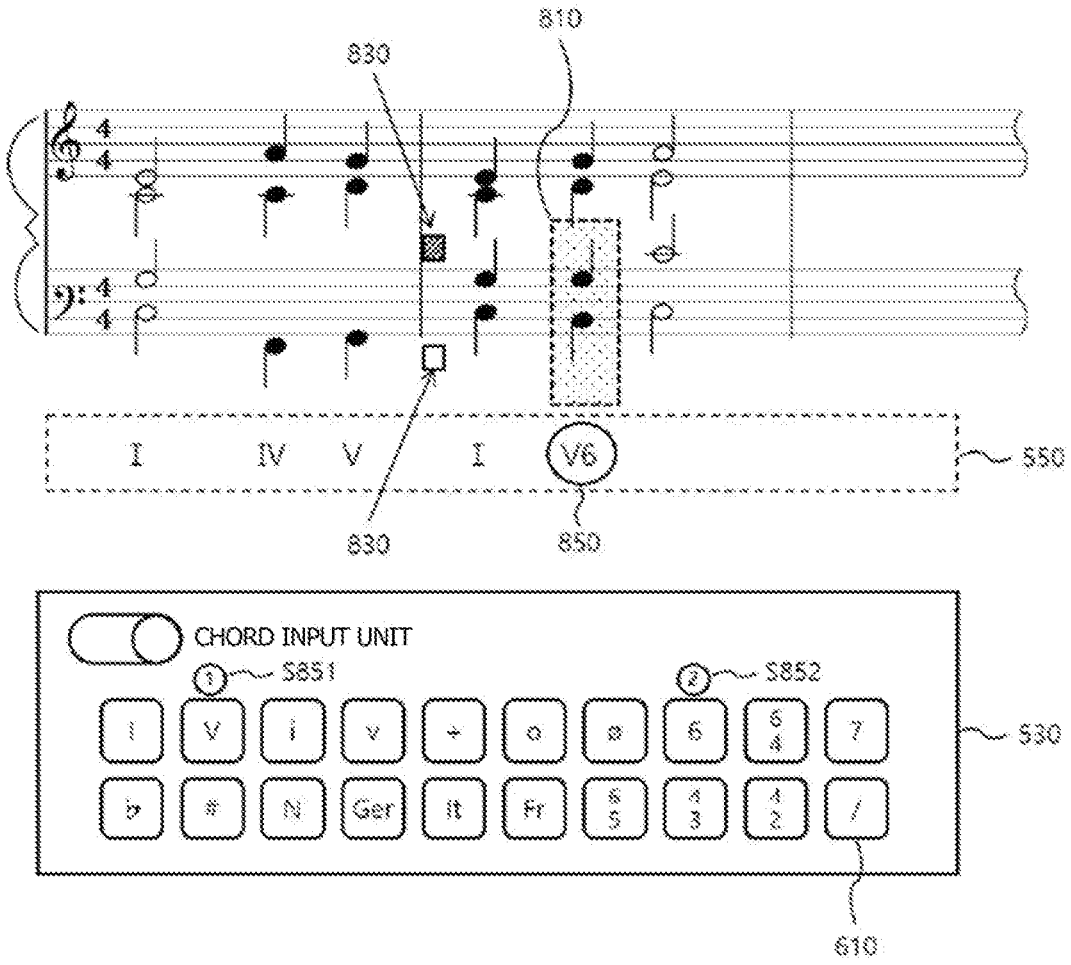
FIG. 8 is a diagram illustrating a harmony symbol input method using the dedicated chord input unit according to the present disclosure.

FIG. 8 is a diagram illustrating a harmony symbol input method using a dedicated chord input unit according to the present disclosure.

Referring to FIG. 8, the harmony symbol input device 130 may provide a dedicated chord input unit for inputting a harmony symbol for each harmony section of a musical notation through the chord input unit provider 330 while visualizing and providing a musical notation through the musical notation provider 310. Further, the harmony symbol input device 130 may repeat an operation that provides highlighting for a specific harmony section in a progression order of a musical notation through the harmony symbol display part 350 and displays a harmony symbol received from the dedicated chord input unit in relation to the highlighting.

In particular, the harmony symbol may be displayed inside or outside a highlighted region 810. In FIG. 8, the harmony symbol may be displayed adjacent to a lower end of a region outside the highlighted region 810. That is, the harmony symbol display region 550 may be disposed below staves on a musical notation, and the harmony symbol may be displayed on the harmony symbol display region 550.

Meanwhile, the harmony symbol input device 130 may determine a specific harmony section depending on a selection input of a user on the musical notation that is visualized and displayed through the harmony symbol display part 350 and visualize and display a bar in which the specific harmony section is included so as to be distinguished from the other bars on the musical notation. In the case of FIG. 8, the harmony symbol input device 130 may separately generate bar dividers 830 and display the bar dividers 830 at upper and lower ends of a bar start portion on the musical notation. When a change in bar is detected in the progression of the musical notation, the harmony symbol input device 130 may move and display the bar dividers 830 to preset positions of the next bar. The bar dividers 830 may be equivalent to identification symbols for distinguishing a bar. Here, the bar dividers 830 are expressed as objects having a quadrilateral structure but, without being necessarily limited thereto, it goes without saying that the bar dividers 830 may be implemented in various shapes, sizes, and colors.

Further, a user may complete a harmony symbol 850 that is being input at present through the dedicated chord input unit. For example, in the case where a harmony symbol to be input is "V6", the user may select a partial key "V" on the dedicated chord input unit (S851), and then select a partial key "6" (S853). That is, the user may successively select a partial key constituting a harmony symbol among partial keys 610 on the dedicated chord input unit, and input the harmony symbol. When the input of the harmony symbol for a specific harmony section is completed, the highlighted region 810 may be generated and displayed for the next harmony section. The user checks this and then may input the harmony symbol for the harmony section.

A complicated harmony symbol will be described by way of example. In the case of a harmony symbol "ii6", a user may continuously select "i" twice, then select a partial key "6" and complete an input of the harmony symbol. In the case of a harmony symbol "bVI", a user may successively select "b", "V", and "I", and complete an input of the harmony symbol.

Referring to FIG. 3 again, the testing musical notation provider 320 may provide a testing musical notation. The testing musical notation provider 320 may directly output the testing musical notation through an internal display screen connected on its own or may indirectly output the testing musical notation through an external display screen connected by a network such as the user terminal 110. The testing musical notation may be equivalent to a musical notation that includes tonality, scale, harmony and harmony progression information about a specific vocal part as a problem for a harmonic test. Here, the vocal part may include soprano, alto, tenor, bass, and so on.

That is, the testing musical notation provider 320 may provide a musical notation relevant to at least one of the four vocal parts as the testing musical notation, and a user may complete a musical notation for the remaining vocal parts to be input as a solution to the testing musical notation. Further, the testing musical notation provider 320 may utilize various musical notations stored in the database 150 to generate the testing musical notation and utilize various interfaces to output the testing musical notation.

The scoring musical notation input part 340 may receive a scoring musical notation based on a musical instrument playing input or a harmony input depending on an input selection of a user. That is, the scoring musical notation input part 340 may directly receive the scoring musical notation, as a solution to the testing musical notation, from the user terminal 110. To this end, the scoring musical notation input part 340 may provide an interface for inputting a musical notation and may be configured to be integrated with an interface for providing, especially, the testing musical notation. The scoring musical notation may include tonality, scale, harmony, and harmony progression information about a vocal part other than a vocal part provided from the testing musical notation as a musical notation input by a user.

In an embodiment, the scoring musical notation input part 340 may generate a keyboard interface for the musical instrument playing input along with the testing musical notation, provide the keyboard interface as a basis, and selectively provide input interfaces for a harmony symbol, a harmony character, and harmony inversion depending on a selection of a user for a harmony input. Here, the input interface may include selection options defined by each of the harmony symbol, the harmony character and the harmony inversion, and the selection options may be divided and determined according to a class of harmonics. This will be described in more detail with reference to FIGS. 12 and 13.

That is, the scoring musical notation input part 340 may provide various interfaces for inputting a musical notation and provide an interface as related to, representatively, a method of directly inputting notes one by one through a keyboard or a method of selecting information about a harmony on the basis of a specific note and simultaneously inputting the remaining notes constituting the harmony.

When scoring is performed, the harmony scoring element overlay part 360 may overlay vertical and horizontal harmony scoring elements using a visual connecting element between a testing musical notation and a scoring musical notation. That is, the harmony scoring element overlay part 360 directly displays visualized scoring elements on a musical notation input by a user, and thereby may be operated such that the user can intuitively understand an evaluation process. The vertical and horizontal harmony scoring elements may be formed in relation to vertical and horizontal harmony scoring rules and may be graphically visualized and displayed on a display screen. This will be described in more detail with reference to FIG. 14.

In an embodiment, the harmony scoring element overlay part 360 may apply colors between the vertical and horizontal harmony scoring elements so as to be different from each other. That is, the harmony scoring element overlay part 360 enables a user to easily distinguish the scoring elements through visualization using a color change. Further, transparency may be differentially applied to the colors depending on a result of scoring the harmony scoring elements. This allows the harmony scoring element overlay part 360 to intuitively distinguish the scoring elements through the colors and indirectly check an evaluation point depending on a degree of transparency.

More specifically, the vertical and horizontal harmony scoring elements are expressed as different colors by the harmony scoring element overlay part 360, and thereby enable a user to easily check whether a musical notation input by the user violates any vertical harmony scoring rules or horizontal harmony scoring rules. Preferably, the vertical and horizontal harmony scoring elements may provide mutual distinguishment through a change in color but provide the same function through a change in size or shape if necessary.

In another embodiment, the harmony scoring element overlay part 360 may display harmony scoring elements endowed with a penalty point that exceeds a preset critical point as a result of scoring each of the vertical and horizontal harmony scoring elements so as to be distinguished from the other harmony scoring elements. For example, the harmony scoring element overlay part 360 may display the harmony scoring elements endowed with the penalty point that exceeds the critical point by highlighting boundaries of the harmony scoring elements or by applying a blink effect to the harmony scoring elements.

In an embodiment, in the case where, as a result of applying a plurality of pre-defined vertical harmony scoring rules to notes falling in the same time frame in the testing musical notation and the scoring musical notation, the notes violate at least one vertical harmony scoring rule, the harmony scoring element overlay part 360 may generate a vertical harmony scoring element that visually connects the notes. That is, the vertical harmony scoring element may serve to display a harmony that does not observe the vertical harmony scoring rules, and this enables a user to directly check and learn his/her own error.

In this case, the plurality of vertical harmony scoring rules may include diatonic use rules, voice-specific range observance rules, voice overlapping prohibition rules, voice-crossing prohibition rules, inter-voice interval restriction rules, authentic cadence omission note rules, inversion relevant rules, and intra-harmony omission note rules. This will be described in more detail with reference to FIG. 10.

In another embodiment, in the case of receiving a selection of a user for the vertical harmony scoring elements displayed on a screen, the harmony scoring element overlay part 360 may display a correct answer harmony while providing information about the vertical harmony scoring elements through a separate interface. For example, a user may check the testing musical notation and the scoring musical notation displayed on a screen and simultaneously check the harmony scoring elements that are overlaid on and displayed with the musical notations.

In this case, the user may select a specific harmony scoring element displayed on a screen, and the harmony scoring element overlay part 360 may display harmony scoring rules and penalty point information relevant to the harmony scoring elements through a separate pop-up window on the basis of the selection. Further, the harmony scoring element overlay part 360 may additionally display a correct answer harmony of the harmony scoring rules along with this display.

Meanwhile, the harmony scoring element overlay part 360 may perform an operation of generating the correct answer harmony of the harmony scoring rules through the following steps.

1) Receive a selection of a user for a specific harmony scoring element, 2) determine the harmony scoring rules relevant to the harmony scoring element, 3) determine a reference note relevant to the harmony scoring element in the testing musical notation, 4) search the correct answer harmony in the database 150 on the basis of the reference note and the harmony scoring rules, and 5) when the correct answer harmony is searched, output the information through an interface relevant to the harmony scoring element.

Further, the harmony scoring element overlay part 360 may visually replace notes of the scoring musical notation input by a user on the basis of the correct answer harmony. For example, in the case where a user selects a specific harmony scoring element, the harmony scoring element overlay part 360 may output a process of replacing the notes of the scoring musical notation input by a user through a separate interface to a position of the correct answer harmony in real time while providing scoring information. This enables a user to intuitively understand a difference between the correct answer harmony and a harmony input by the user.

In an embodiment, as a result of applying a plurality of pre-defined horizontal harmony scoring rules to at least two notes that continuously proceed in the testing musical notation and the scoring musical notation while falling in the same vocal part, in the case where the two notes violate at least one horizontal harmony scoring rule, the harmony scoring element overlay part 360 may generate a horizontal harmony scoring element that visually connects the notes.

In this case, the plurality of horizontal harmony scoring rules may include intra-voice progression rules, melody progression rules, inter-bar harmony connection rules, harmony conjunct progression rules, and note resolution rules. This will be described in more detail with reference to FIG. 11.

In another embodiment, in the case of receiving a selection of a user for the horizontal harmony scoring elements displayed on a screen, the harmony scoring element overlay part 360 may display the correct answer harmony while providing information about the horizontal harmony scoring elements through a separate interface. A user may select a specific harmony scoring element, and depending on the selection, the harmony scoring element overlay part 360 may additionally display the harmony scoring rules relevant to the harmony scoring element, and the correct answer harmony for the harmony scoring rules along with the penalty point information.

For example, the harmony scoring element overlay part 360 may determine horizontal harmony scoring rules relevant to a horizontal harmony scoring element selected by a user and determine a reference note relevant to the horizontal harmony scoring element in a testing musical notation. The harmony scoring element overlay part 360 may search a correct answer harmony in the database 150 on the basis of the reference note and the horizontal harmony scoring rules and when the correct answer harmony is searched, output the search information through an interface relevant to the horizontal harmony scoring element. In this case, the correct answer harmony may include a melody or a harmony using the reference note as a start note and be audible and output through a playback means of the user terminal 110 if necessary.

In an embodiment, in the case where a chord pair that continuously proceeds to chords provided for each time frame along with a testing musical notation and a scoring musical notation violates pre-defined harmony progression rules, the harmony scoring element overlay part 360 may generate and overlay a harmony analysis scoring element that visually connects chords of the chord pair. That is, the harmony analysis scoring element may serve to visually display a portion at which a flow of harmony progression on a musical notation is not natural. Meanwhile, the harmony scoring element overlay part 360 may basically overlay a harmony analysis scoring element visualized for the preceding chord of the chord pair but, without being necessarily limited thereto, naturally generate and display a harmony analysis scoring element visualized for the following chord of the chord pair or the chord pair itself.

The controller 370 may control a whole operation of the harmony symbol input device 130 and manage a control flow and a data flow among the testing musical notation provider 320, the scoring musical notation input part 340, and the harmony scoring element overlay part 360.

Figure 9:
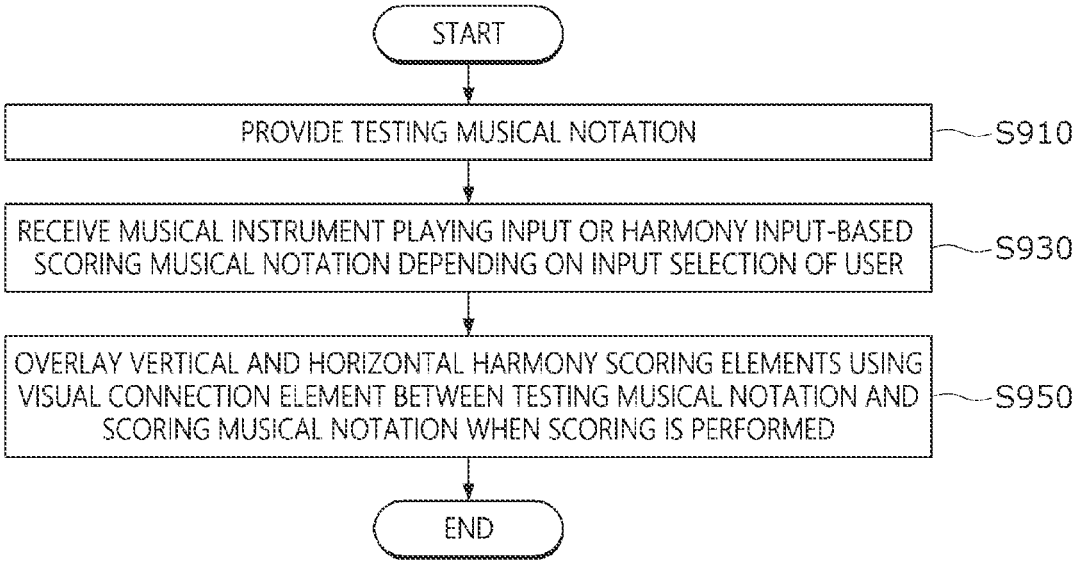
FIG. 9 is a flow chart illustrating a harmony scoring process according to an embodiment of the present disclosure.

FIG. 9 is a flow chart illustrating a harmony scoring process according to an embodiment of the present disclosure.

Referring to FIG. 9, the harmony symbol input device 130 may provide a testing musical notation through the testing musical notation provider 320 (step S910). The harmony symbol input device 130 may receive a musical instrument playing input or harmony input-based scoring musical notation depending on an input selection of a user through the scoring musical notation input part 340 (step S930). When scoring is performed, the harmony symbol input device 130 may overlay vertical and horizontal harmony scoring elements using a visual connection element between the testing musical notation and the scoring musical notation through the harmony scoring element overlay part 360 (step S950).

FIG. 10 is a diagram illustrating vertical harmony scoring rules according to the present disclosure, and FIG. 11 is a diagram illustrating horizontal harmony scoring rules according to the present disclosure.

Referring to FIGS. 10 and 11, rules for harmonics may be variously analyzed according to definition thereof. In an embodiment, rules that should be essentially applied in fundamental harmonics may be defined as in tables illustrated in FIGS. 10 and 11. Here, on the presumption that a level of a learner is a basic learner, the harmonic rules may be generally divided and defined into vertical harmony rules and horizontal harmony rules. That is, vertical and horizontal harmony scoring rules according to the present disclosure may correspond to vertical and horizontal harmony rules, respectively.

Specifically, vertical harmony placement and operation rules in FIG. 10 may be defined as vertical harmony scoring rules, and voice progression rules in FIG. 11 may be defined as horizontal harmony scoring rules.

In FIG. 10, the vertical harmony rules may be defined as harmony rules that can be applied irrespective of a flow of time. Here, it is assumed that a diatonic scale is used when a learning environment is configured without using a chromatic scale, but the present disclosure is not necessarily limited thereto. Therefore, kinds of chords to be used may include a primary triad, a secondary triad, a leading-tone triad, a dominant seventh chord, a leading-tone seventh chord, and a secondary seventh chord. In the case of a vocal-part range, Soprano may be fixed at C4 to G5, Alto may be fixed at G3 to D5, Tenor may be fixed at C3 to G4, and Bass may be fixed at E2 to C4.

Further, neighboring vocal parts may be closely placed. It is possible to prevent exceeding and placing an octave between three upper vocal parts, namely between Soprano and Alto and between Alto and Tenor. However, placement in which an octave exceeds between Tenor and Bass may be freely used. "Voice crossing", which is a situation in which a vocal part overlaps a neighboring vocal part and thus is instantaneously made lower or higher than the neighboring vocal part, may be prohibited. "Voice overlapping", in which a vocal part overlaps a region where a neighboring vocal part is present while proceeding, may also be regarded as an element that obstructs smooth vocal-part progression and prohibited.

However, when a melody including a severe large leap such as an octave leap is harmonized, the voice overlapping cannot be avoided. In that case, the voice overlapping may be permitted as an exception. Here, on the presumption that a harmony is an elementary harmony, description will be made to the exclusion of such a special situation.

In FIG. 11, the vocal-part progression rules may be defined as a motion of vocal parts between harmonies and, more particularly, as rules of one melody motion. That is, the horizontal harmony rules may be equivalent to harmony rules influenced by a flow of time.

First, two notes that are continuous in the same vocal part may be restricted within one octave.

Further, prohibited melody progressions may be prescribed, which may include an augmented interval between two notes, a seventh-note leap or a leap larger than an octave, successive fourth-note leaps in the same direction, a leap in the same direction after a sixth-note leap, and no resolution of a leading tone. Melody progression prohibited between three notes may include an octave leap between three notes. Parallel 1/5/8 notes and hidden 5/8 notes may be prohibited between every two vocal parts. A seventh note of a V7 chord may be made to be resolved by conjunct downward progression, and the same harmony connection between bars may be restricted to be prohibited as much as possible.

Further, in the case where a leading tone exists in the soprano vocal part, the leading tone may be necessarily restricted to be resolved by a tonic. In the case of bass, the leading tone may be restricted to proceed to one of do, la, and sol. This may be relevant to the case of proceeding to each of I, vi, and V7 chords. A diminished fifth note interval may be necessarily restricted to be resolved by conjunct upward progression after diminished fifth note downward progression for all vocal parts according to a principle of "complementary motion", and by conjunct downward progression after diminished fifth note upward progression FIGS. 12 and 13 are diagrams illustrating an example of a screen configuration according to the present disclosure.

Figure 12:
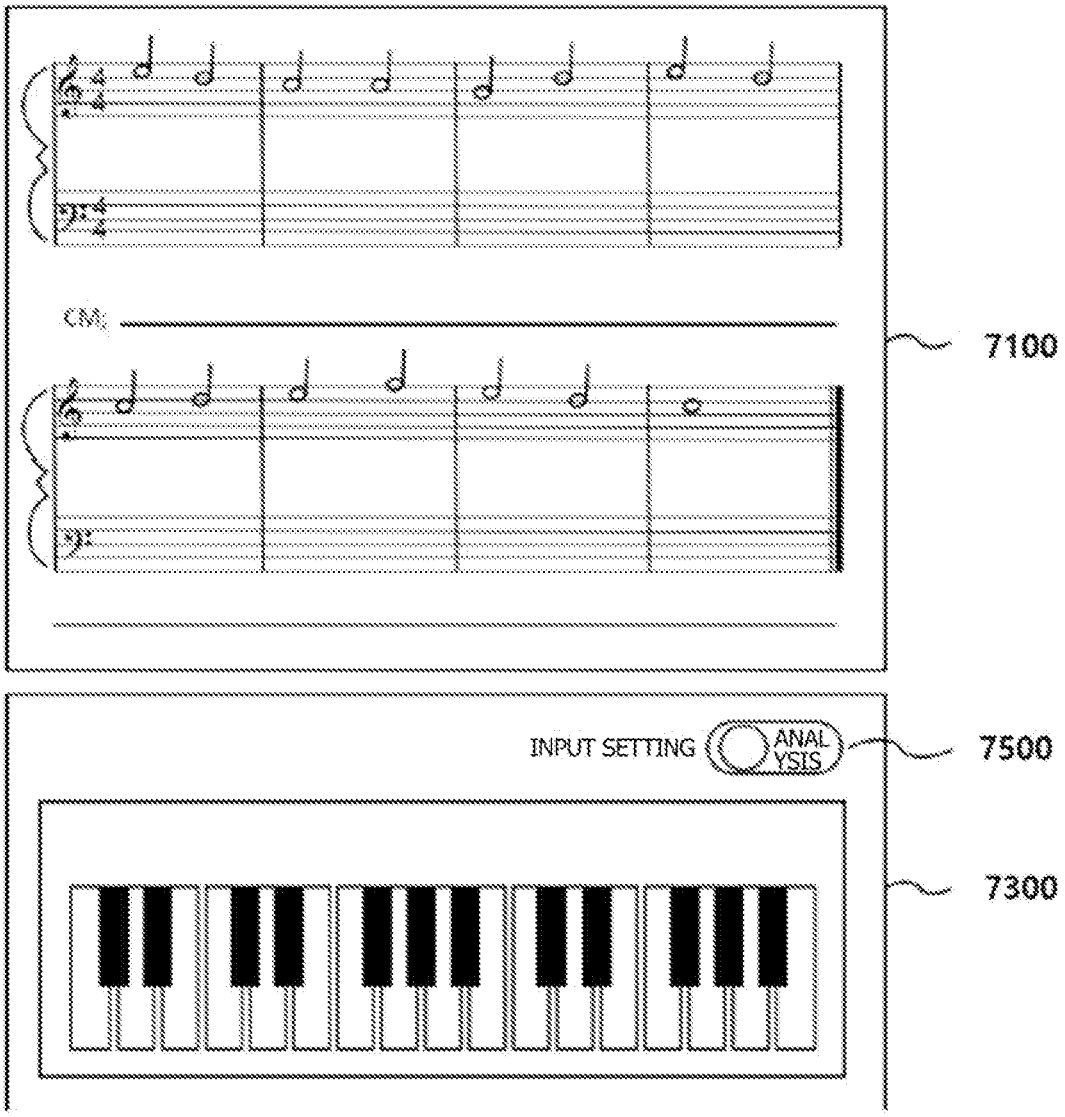
FIGS. 12 and 13 are diagrams illustrating an example of a screen configuration according to the present disclosure.
Figure 13:
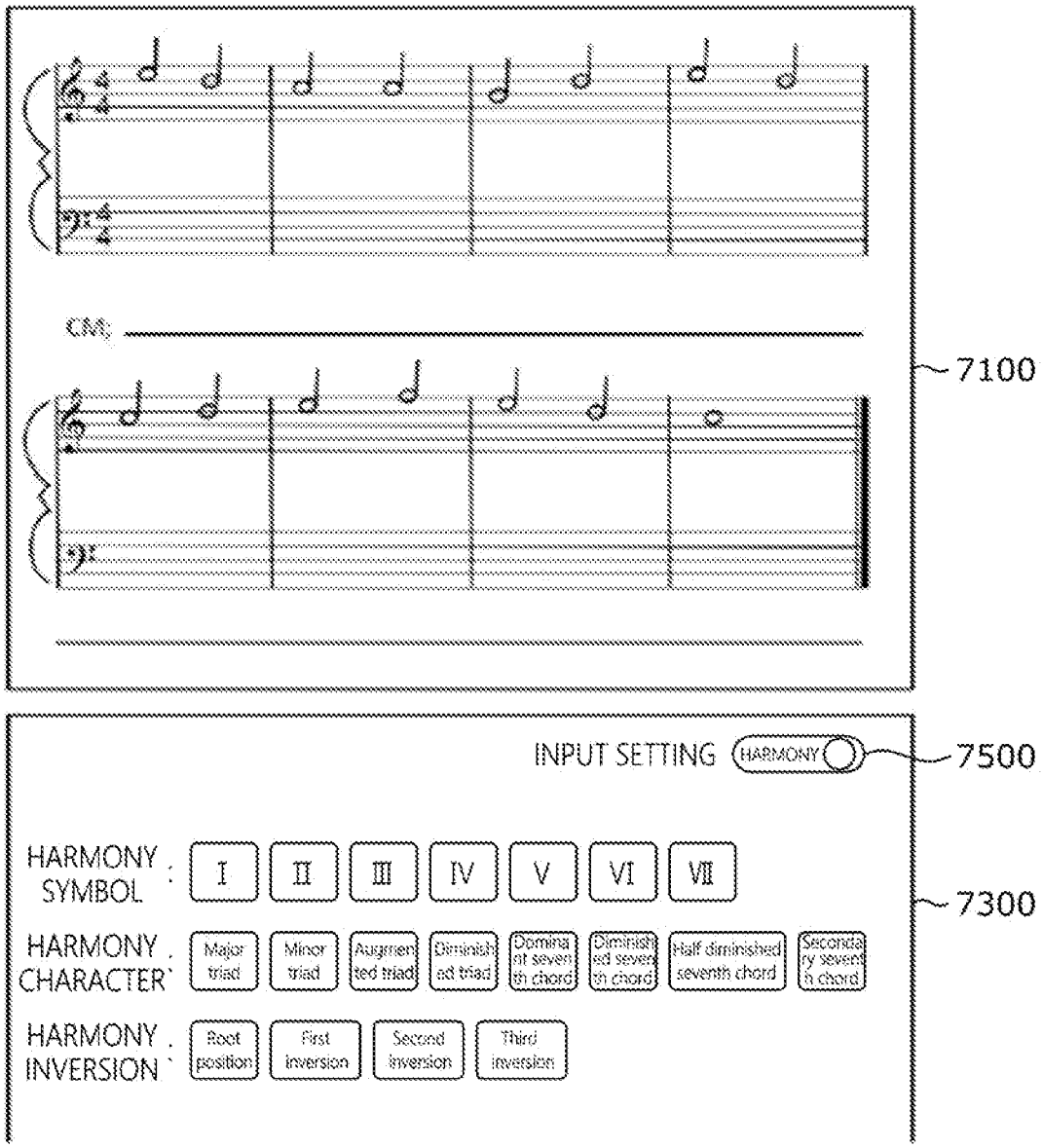

Referring to FIGS. 12 and 13, an example of a screen configuration may be equivalent to an example of a player screen capable of solving a harmonic problem. The harmony symbol input device 130 may divide and output a musical notation region 7100 that displays a testing musical notation and a scoring musical notation and output an input region 7300 that displays an interface for inputting the scoring musical notation. In this case, the input region 7300 may include an input menu 7500 that can select an input mode (e.g., a chord input or an analysis input), and the input menu 7500 may be implemented by a toggle menu.

Meanwhile, the harmony symbol input device 130 may provide a menu that can move to a former problem, play back a problem, stop playback, and move to the next problem through a separate interface (not illustrated in the figure). Further, the harmony symbol input device 130 may provide a menu that plays back an answer input by a user, a menu to which a scoring screen for solving a problem at the time of clicking is output, and a toggle menu that allows a keyboard sound to be output when a note is input using a piano interface.

In an embodiment, the harmony symbol input device 130 may selectively provide a keyboard interface that can input a note as in FIG. 12 and an interface that can input a harmony symbol as in FIG. 13. Here, the interface for inputting a harmony symbol, namely a method of inputting a harmony symbol, may be equivalent to an element that is very important in a user experience.

In FIG. 12, in the case of the chord input, a user may directly select a keyboard through the keyboard interface and input a desired note. In FIG. 13, in the case of the analysis input, a user may sequentially select a harmony symbol, character, and inversion through the interface, and input a relevant note.

In an embodiment, the harmony symbol input device 130 may use a method of filtering a harmony symbol using a dropdown filter and allowing a user to finally select. In a first dropdown button, a diatonic/chromatic chord may be divided and selected. In this menu, a diatonic triad, diatonic seventh chords, a chromatic triad, and chromatic seventh chords may be noted. In the case of the diatonic triad, the kinds of harmonies may be sorted into a primary triad, a secondary triad, and a leading-tone triad. In the case of the diatonic seventh chords, the kinds of harmonies may be sorted into a dominant triad, a leading-tone seventh chord, and secondary seventh chords. A harmony notation may be implemented such that the harmony notation is completed by selecting a desired harmony thereafter and finally selecting inversion. The chromatic chords may be all sorted through this method.

Figure 14:
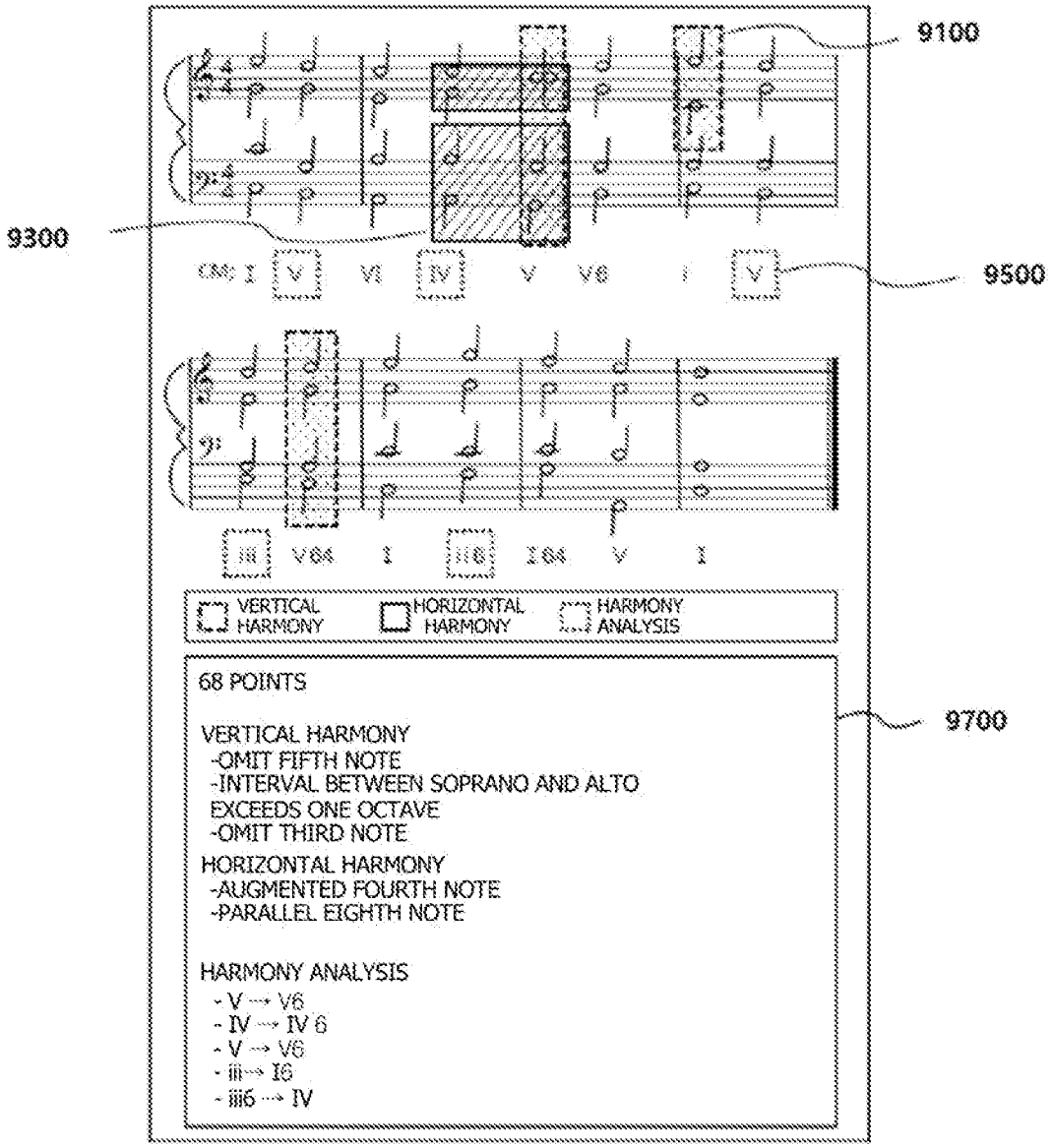
FIG. 14 is a diagram illustrating a harmony scoring element overlay operation according to the present disclosure.

FIG. 14 is a diagram illustrating a harmony scoring element overlay operation according to the present disclosure.

Referring to FIG. 14, the harmony symbol input device 130 may include a vertical harmony, a horizontal harmony, and a harmony analysis as scoring elements. The harmony symbol input device 130 may perform scoring by calculating the vertical harmony, the horizontal harmony, and the harmony analysis at a ratio of 1:1:1 and provide a scoring result 9700 of the scoring elements. The harmony symbol input device 130 may perform harmony scoring in consideration of the following elements. That is, the harmony symbol input device 130 may define prohibited progression rules as scoring rules and perform the harmony scoring.

1) Vertical harmony: adjacent note/triad omission, voice overlapping, an interval between two of three upper vocal parts is made wider than an octave, and spacing that departs from each range of SATB 2) Horizontal harmony: parallel 1/5/8 notes (applied to all of the vocal parts), hidden 5/8 notes (only Soprano and Bass), augmented 2/4 notes, resolution of conjunct downward progression of seven notes of a seventh chord, resolution based on a tonic when a leading tone reaches soprano, a seventh-note leap in all of the vocal parts, a leap larger than an octave in the vocal parts excluding bass, and progression to a perfect fifth note of a diminished fifth note relevant to bass 3) Harmony analysis: harmony analysis that is not matched with a character of a chord The harmony symbol input device 130 may overlay vertical harmony scoring elements 9100 and horizontal harmony scoring elements 9300 through the harmony scoring element overlay part 360 using a visual connection element between a testing musical notation and a scoring musical notation in a scoring process. Further, the harmony symbol input device 130 may generate and overlay a harmony analysis scoring element 9500, which visually connects chords of a chord pair constituted by the testing musical notation and the scoring musical notation, through the harmony scoring element overlay part 360.

What is claimed is:

1. A harmony symbol input device using a dedicated chord input unit, comprising:

a musical notation provider configured to visualize and provide a musical notation;

a chord input unit provider configured to provide a dedicated chord input unit for inputting a harmony symbol in each harmony section of the musical notation; and a harmony symbol display part configured to repeat an operation that provides highlighting for a specific harmony section in a progression order of the musical notation and displays the harmony symbol received from the dedicated chord input unit in relation to the highlighting, wherein the dedicated chord input unit is made up of partial key lists that are vertically disposed side by side and are generated on the basis of a set of partial keys.

2. The harmony symbol input device of claim 1, wherein:

the dedicated chord input unit includes at least two partial key lists;

each of the partial key lists is generated on the basis of a set including {'I', 'V', 'i', 'v', '+', 'o', 'ø', '6', '$_4^6$', '7'} or {'b', '#', 'N', 'Ger', 'It', 'Fr', '$_5^6$', '$_3^4$', '$_2^4$', '/'} and is implemented by an interface that independently selects each of the partial keys.

3. The harmony symbol input device of claim 1, wherein the chord input unit provider is operated through:

a step of detecting a change in bar according to progression of the musical notation;

a step of, in the case where the change is detected, extracting at least one note included in the changed bar from the musical notation;

a step of generating a set of harmony symbols generated by a combination of the at least one note;

a step of determining essential partial keys required to input the harmony symbol for the changed bar on the basis of the set of harmony symbols; and a step of activating and providing only the essential partial keys on the dedicated chord input unit in the process of inputting the harmony symbol for the changed bar.

4. The harmony symbol input device of claim 1, wherein the harmony symbol display part determines whether to continue inputting the harmony symbol for the specific harmony section while sequentially receiving the partial key based on a selection of a user from the dedicated chord input unit.

5. The harmony symbol input device of claim 4, wherein, in the case where the continuation is determined by the harmony symbol display part, the chord input unit provider determines the partial key that is merged with a first harmony symbol that is previously received and displayed, and visualizes and provides the partial keys so as to be distinguished from the other keys on the dedicated chord input unit.

6. The harmony symbol input device of claim 4, wherein, in the case where the input of the harmony symbol is continued, when the partial key that is merged with a first harmony symbol that is previously received and displayed is received, the harmony symbol display part generates a second harmony symbol based on the mergence and displays the second harmony symbol in place of the first harmony symbol, or when the partial key that is not merged with the first harmony symbol is received, the harmony symbol display part terminates the input of the harmony symbol for the specific harmony section and automatically proceeds to a harmony section next to the specific harmony section.

7. The harmony symbol input device of claim 1, wherein the harmony symbol display part determines the specific harmony section according to a selection input of a user on the visualized and displayed musical notation, and visualizes and displays a bar in which the specific harmony section is included so as to be distinguished from the other bars on the musical notation.

8. The harmony symbol input device of claim 1, further comprising:

a testing musical notation provider configured to provide a testing musical notation;

a scoring musical notation input part configured to receive a musical instrument playing input or harmony input-based scoring musical notation depending on an input selection of a user; and a harmony scoring element overlay part configured to overlay vertical and horizontal harmony scoring elements using a visual connection element between the testing musical notation and the scoring musical notation when scoring is performed.

9. The harmony symbol input device of claim 8, wherein:

the scoring musical notation input part generates a keyboard interface for the musical instrument playing input along with the testing musical notation, provides the keyboard interface as a basis, and selectively provides input interfaces for a harmony symbol, a harmony character, and harmony inversion depending on a selection of a user for a harmony input;

the input interfaces include selection options defined by each of the harmony symbol, the harmony character and the harmony inversion; and the selection options are divided and determined according to a class of harmonics.

10. The harmony symbol input device of claim 8, wherein:

the harmony scoring element overlay part applies different colors between the vertical and horizontal harmony scoring elements; and each of the colors has transparency that is differentially applied depending on a scoring result of the harmony scoring element.

11. The harmony symbol input device of claim 8, wherein, in the case where a plurality of pre-defined vertical harmony scoring rules are each applied to notes falling in the same time frame in the testing musical notation and the scoring musical notation and, as a result, the notes violate at least one of the vertical harmony scoring rules, the harmony scoring element overlay part generates a vertical harmony scoring element that visually connects the notes.

12. The harmony symbol input device of claim 11, wherein the plurality of vertical harmony scoring rules include diatonic use rules, vocal-part-specific range observance rules, voice overlapping prohibition rules, voice-crossing prohibition rules, inter-voice interval restriction rules, authentic cadence omission note rules, inversion relevant rules, and intra-harmony omission note rules.

13. The harmony symbol input device of claim 8, wherein, in the case where a plurality of pre-defined horizontal harmony scoring rules are each applied to at least two notes that successively proceed while falling in the same vocal part in the testing musical notation and the scoring musical notation and, as a result, the notes violate at least one of the horizontal harmony scoring rules, the harmony scoring element overlay part generates a horizontal harmony scoring element that visually connects the notes.

14. The harmony symbol input device of claim 13, wherein the plurality of horizontal harmony scoring rules include intra-voice progression rules, melody progression rules, inter-bar harmony connection rules, harmony conjunct progression rules, and note resolution rules.

15. A harmony symbol input method using a dedicated chord input unit, comprising:

a step of visualizing and providing a musical notation;

a step of providing a dedicated chord input unit for inputting a harmony symbol in each harmony section of the musical notation; and a step of repeating an operation that provides highlighting for a specific harmony section in a progression order of the musical notation and displays the harmony symbol received from the dedicated chord input unit in relation to the highlighting, wherein the dedicated chord input unit has at least two partial key lists that are vertically disposed side by side, and each of the partial key lists is generated on the basis of a set of partial keys.

* * * * *